US010683980B2

(12) United States Patent
Garin et al.

(10) Patent No.: US 10,683,980 B2
(45) Date of Patent: Jun. 16, 2020

(54) LIGHTING MODULE FOR VEHICLE LIGHT

(71) Applicant: Valeo Vision, Bobigny (FR)

(72) Inventors: Pascal Garin, Bobigny (FR); Stephane Andre, Bobigny (FR); Nicolas Laloge, Bobigny (FR)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 16/230,208

(22) Filed: Dec. 21, 2018

(65) Prior Publication Data

US 2019/0195449 A1 Jun. 27, 2019

(30) Foreign Application Priority Data

Dec. 22, 2017 (FR) ..... 17 62902

(51) Int. Cl.

| | |
|---|---|
| ***F21S 41/19*** | (2018.01) |
| ***F21S 41/143*** | (2018.01) |
| ***F21S 41/24*** | (2018.01) |
| ***F21S 41/29*** | (2018.01) |
| *F21S 41/141* | (2018.01) |
| *F21S 45/47* | (2018.01) |

(52) U.S. Cl.

CPC ..... *F21S 41/192* (2018.01); *F21S 41/143* (2018.01); *F21S 41/24* (2018.01); *F21S 41/29* (2018.01); *F21S 41/141* (2018.01); *F21S 45/47* (2018.01)

(58) Field of Classification Search

CPC ..... F21S 41/192; F21S 41/29; F21S 41/24; F21S 45/47; F21S 41/141; F21S 41/143

See application file for complete search history.

(56) References Cited

U.S. PATENT DOCUMENTS

| | | | | |
|---|---|---|---|---|
| 9,174,689 | B2 * | 11/2015 | Owada | B60Q 1/0088 |
| 9,327,636 | B2 * | 5/2016 | Wu | F21S 41/19 |
| 2002/0034078 | A1 | 3/2002 | Natsume | |
| 2015/0323147 | A1 | 11/2015 | Kanayama et al. | |
| 2016/0178152 | A1 | 6/2016 | Albou et al. | |
| 2017/0114976 | A1 | 4/2017 | Beev et al. | |

FOREIGN PATENT DOCUMENTS

| | | |
|---|---|---|
| FR | 2 814 221 A1 | 3/2002 |
| FR | 3 030 684 A1 | 6/2016 |
| FR | 3 159 599 A1 | 4/2017 |

OTHER PUBLICATIONS

French Preliminary Search Report dated Jul. 17, 2018 in French Application 17 62902 filed on Dec. 22, 2017 (with English Translation).

* cited by examiner

*Primary Examiner* — Kevin Quarterman

(74) *Attorney, Agent, or Firm* — Oblon, McClelland, Maier & Neustadt, L.L.P.

(57) ABSTRACT

A lighting module for a motor vehicle light includes light sources, optical elements respectively configured to guide light rays emitted by a light source, and a fixing support against which the optical elements and the light sources are disposed, the optical elements including a first optical element associated with a first light source, a second optical element associated with a second light source and a third optical element associated with a third light source. The first optical element includes means for retaining the second optical element and the third optical element on the fixing support.

20 Claims, 2 Drawing Sheets

Fig. 1
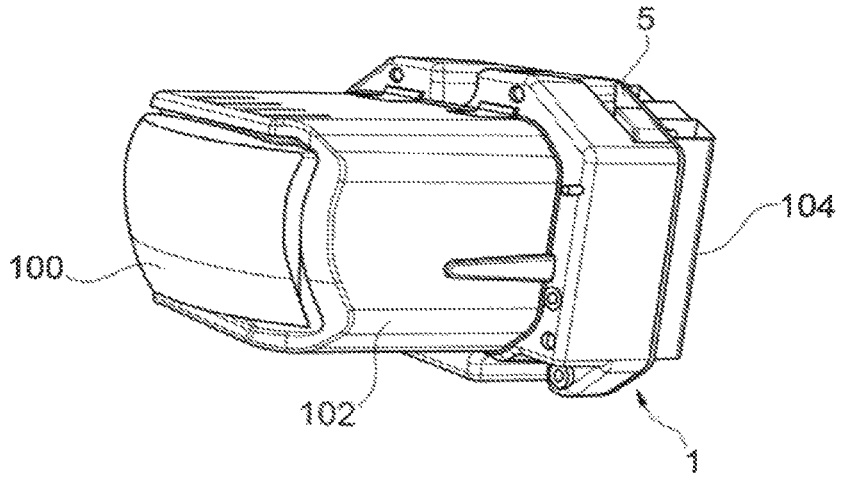
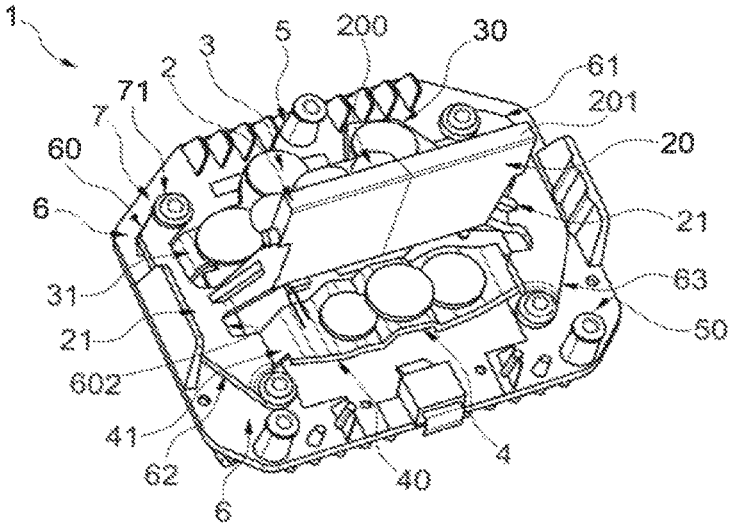
Fig. 2
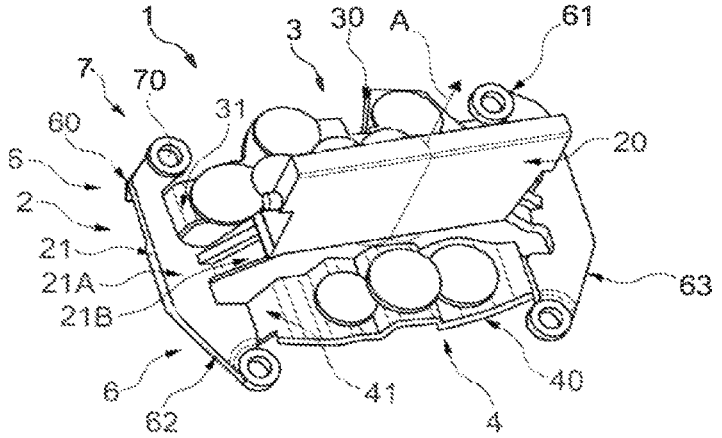
Fig. 3

LIGHTING MODULE FOR VEHICLE LIGHT

The invention relates to the field of lighting and/or signalling devices for motor vehicles. It more particularly concerns lighting modules intended to be mounted in a vehicle light.

Motor vehicle lights are usually made up of a housing that is closed by a transparent wall through which light rays pass. This housing accommodates at least one lighting module, mainly comprising at least one light source and an optical system adapted to modify at least one parameter of the light generated by the light source to emit light rays able thereafter to pass through the transparent wall of the light to form statutory light beams.

Technical evolutions tend to favour the use of light sources constituted of at least one light-emitting diode (LED), because of their low energy consumption, their small overall size and the quality of the lighting obtained.

An optical system equipping a lighting module can comprise optical elements configured to orient the light rays toward a lens for shaping the rays to project a statutory light beam at the outlet of the module and the light. The light sources and the corresponding optical elements can notably be configured to generate a first light beam, termed a high beam, and a second light beam, termed a low beam. According to one known configuration, light sources, for example light-emitting diodes, are fixed to a base also forming a support for the optical elements, so that the position relative to one another is reliable.

In this known configuration, the optical elements of the lighting module are assembled independently of one another onto the base of the lighting module forming a fixing support. To this end, each of the optical elements can comprise openings formed within the thickness of the material, advantageously in end zones of these optical elements so as to not to penalize the guiding of light rays within them, and the optical elements are mounted on the fixing support so that these openings are positioned facing bores formed on the fixing support to enable the optical element to be fixed to the fixing support by means of screws.

Various disadvantages stem from a configuration of this kind and the resulting assembly process. With regard to the assembly process in itself, the necessity to fix each of the optical elements individually by screwing it onto the fixing support generates a long assembly time. Moreover, where the design of the optical elements to equip a module of this kind is concerned, it is necessary to provide specific localization, not penalizing the optical function, and a particular thickness of the zone in which the opening has to be made, so that the design of these optical elements is as much an optical problem, to ensure correct guidance of the light rays, as a mechanical one, to ensure that the fixing onto the support is correct. Another disadvantage of this solution stems from the fact that the optical elements are mechanically stressed by screwing them on. This mechanical stress can have the effect of deforming the optical elements and therefore impacting on the orientation of the light beams at the outlet of the module.

An object of the present invention is to alleviate at least one of the aforementioned disadvantages and to propose a lighting module enabling reduction of its manufacturing and assembly cost whilst avoiding mechanical stressing of the optical elements of a lighting module of this kind.

To this end, the invention consists in a lighting module for a motor vehicle light, comprising light sources, optical elements respectively configured to guide light rays emitted by a light source, and a fixing support against which the optical elements and the light sources are disposed, the optical elements comprising a first optical element associated with a first light source, a second optical element associated with a second light source and a third optical element associated with a third light source. According to the invention, the first optical element comprises means for retaining the second optical element and the third optical element on the fixing support.

Thanks to this first optical element, it is possible to reduce the set of openings and of bores respectively formed on the optical elements and on the fixing support for fixing the former to the latter. Clearly the effect of this is to reduce the cost of machining and assembling a lighting module of this kind. In fact, during assembly steps, only the first optical element is fixed to the fixing support by appropriate means, such as screwing means for example. By way of assembly steps, it is envisaged, for example, to position the second optical element and the third optical element on the fixing support in a first step before positioning the first optical element in a second step so as to retain the second optical element and the third optical element, bearing against the fixing support, and fixing the first optical element to the fixing support in a third step.

It will be noted that retaining the second optical element and the third optical element by means of the first optical element has the advantage of eliminating the mechanical stresses caused by screwing on these second and third optical elements. The mechanical stresses of screwing on the second and third optical elements are then offset to the retaining means of the first optical element.

The means for retaining the first optical element can be configured to cover at least a part of the second optical element and a part of the third optical element.

According to one feature of the invention, each of the optical elements can include an optical guide part, configured to guide the light rays emitted by the first light source and extended laterally by fins, the fins of the first optical element being configured to carry said retaining means, the optical guide part of the first optical element being disposed between the second optical element and the third optical element.

The fact that the first optical element, carrying the retaining means, has a central position enables uniform distribution of the pressure on the optical elements disposed on either side of the central optical element. It is particularly advantageous to use this solution when the central element has a longitudinal dimension, that is to say a dimension along the optical axis, perpendicular to the fixing support, greater than that of the other optical elements. Arranging the retaining means on each side of the first optical element enables stable positioning of that central optical element and uniform distribution of the pressure forces for the position of the other optical elements.

In this configuration of the three optical elements with the first optical element arranged at the centre of the other optical elements, the first optical element can be configured to participate in the formation of a beam complementary to the beam formed by the second optical element, this beam formed by the second optical element being in a so-called low beam. It should be noted that an edge of the central optical portion of the first optical element can form a cut-off edge of the beam formed by the second optical element and its associated light source. The addition of the beam formed by the second optical element and the additional beam generates the formation of an overall beam of high beam type. The third optical element can be configured to enable the formation of an additional beam that boosts the overall beam formed by the complementary nature of said beam and said additional beam.

The means for retaining the first optical element can include, on a first face pressed against the fixing support, at least one notch sized to accommodate one end of the second or third optical element. Thanks to this notch or these notches formed on the first optical element, it is possible to immobilize the second optical element and the third optical element with the aid of the first optical element and to press them correctly against the fixing support. The retaining means carried by the first optical element can bear both against the fixing support, at the level of a first side, and against the other optical elements themselves bearing on the fixing support, at the level of the notches. The pressure force is thus transmitted to the second and third optical elements to clamp them against the fixing support in a stable manner, the first optical element bearing flat against the fixing support.

The first optical element is configured so that the optical guide part directs the light rays along an optical axis toward a shaping lens of the lighting module, and so that the retaining means extend on either side of the optical guide part perpendicularly to the optical axis and along the fixing support.

The retaining means can notably include legs extending the lateral extremities of the optical guide part of the first optical element on either side to cover on the one hand the second optical element and on the other hand the third optical element. Legs of this kind enable separation of the optical function of the first optical element and its function of retaining the second optical element and the third optical element. It will be understood that the covering of the second optical element and the third optical element by the first optical element is a partial covering the aim of which is to make it possible to retain this second optical element and this third optical element without however impeding their optical function. For example, the legs of the first optical element can cover the extremities of each of the second and third optical elements.

The retaining means configured to retain the second and third optical elements comprising a means for fixing the first optical element onto the fixing support. The fixing of the first optical element onto the fixing support, for example by screwing means, enables the second optical element and the third optical element to be fixedly retained against the fixing support. As it was possible to specify above, this ensures the retention and positioning of all of the optical elements with a minimum of fixing means.

The fixing means can more particularly be formed by a hole at one end of a leg forming part of the retaining means, the hole being configured to receive a fixing screw intended to be accommodated in a bore formed in the fixing support. It will be understood here that the mechanical force for screwing on the first element is not eliminated, unlike the second optical element and the third optical element. However, the mechanical force of screwing on the first optical element is transferred from its bases to the ends of its legs.

According to one feature of the invention, the legs forming part of the retaining means can be grouped into pairs of legs configured to retain each extremity of an optical element: a first pair of legs can be associated with the second optical element and a second pair of legs can be associated with the third optical element.

The pairs of legs can be configured so that each leg comprises a first portion and a second portion, the second portion being consecutive to the first portion, the first portion comprising the notch of the corresponding leg adapted to receive a fin of an optical element, the second portion comprising the fixing means of the corresponding leg, the second portion being oriented in a direction different form the direction of the first portion. However, the invention is not limited to this configuration, and the first portion and the second portion of a leg can be oriented in the same direction, notably for reasons of overall size and/or the stability of the first optical element.

According to one feature, the fixing means of at least one leg of a pair of legs is formed facing the notch of the corresponding leg. The aim of this embodiment is to combine the retention of the second and third optical elements with fixing the first optical element by screwing it on. To this end, it will be understood that when the fixing means is formed by a hole, that hole is formed on the leg to pass through the corresponding notch and to be in corresponding relationship with, on the one hand, an opening formed in the corresponding fin of the second or third optical element and, on the other hand, a bore of the fixing support.

According to features of the invention:

The optical guide part and the retaining means of an optical element can be formed in one piece. More particularly, the retaining means of an optical element are moulded over the optical guide part, at least the optical guide part being made of polycarbonate (PC), a material notably chosen for its temperature resistance. Thanks to this overmoulding technique, it is possible to reduce the cost of manufacturing the first optical element by using a plastic different from that used to make the optical guide part. As a result a material offering high optical performance can be preferred for the production of the optical guide part and a stronger and less costly material for the fins. It will be understood that in these two variant embodiments, one objective is to form a one-piece first optical element formed by its optical guide part and its means for retaining the other optical elements.

The fins of each optical element are formed by a first portion, arranged directly in line with the corresponding lateral extremity of the optical guide part and by a second portion intended to be pressed against the fixing support. The first portion is adapted to raise the corresponding optical guide part and the second portion is adapted to be accommodated in corresponding relationship in one of the notches of the retaining means. The object of this configuration of the fins is to offset the retaining function and the optical function of the optical elements axially, parallel to the optical axis.

The second portions of the fins of the second and third optical elements are at least partially accommodated in said notches, the second portions of the fins of the first optical element being extended by said retaining means.

At least one fin of an optical element comprises an indexing pin configured to cooperate with an orifice formed in the fixing support. It is then possible to position the first optical element on the fixing support with the first optical element correctly positioned relative to the fixing support guaranteed. Thanks to this configuration of the first optical element, it is possible to align at least one first light source with the optical guide part of the first optical element.

At least one indexing pin fastened to a second and/or third optical element projects in a second part of a fin of said optical element covered by the first optical element at the level of a notch.

The indexing pins of the second optical element and the indexing pins of the third optical element have the advantage of enabling positioning of their respective optical element on the fixing support so that the first optical element and the second optical element respectively face at least one second light source and at least one third light source.

The lighting module can be configured so that each optical element is disposed between a light source of each of the light beams and a shaping lens at the outlet of the lighting module. Each optical element can be configured to emit a light beam in the direction of this shaping lens arranged at the outlet of the lighting module.

It is then clear that the light beams from the light source are guided by the corresponding optical element and then projected toward the shaping lens to form alternatively a first, so-called high beam luminous flux and a second, so-called low beam luminous flux. This first, so-called high beam luminous flux corresponds to the configuration of a motor vehicle in a high beam position and this second, so-called low beam luminous flux corresponds to the configuration of a motor vehicle in a low beam position.

According to one feature of the invention, the shaping lens is adapted to shape at least a part of the light beams in order to:

- project at least the light rays leaving the second optical element as a so-called low beam light beam, that is to say one comprising a cut-off zone, and
- project at least the same rays as well as the light rays leaving the first optical element as an overall, so-called high beam light beam.

In this context, in particular:

- the optical elements can be distinguished from one another so that the first optical element can comprise an optical guide part for first light rays, the second optical element can comprise an optical guide part for second light rays and the third optical element can comprise an optical guide part for third light rays,
- the central optical portion of the first optical element, arranged between the other two optical elements, has an elongate shape along the optical axis of the lighting module, so as to extend beyond the second and third optical elements, away from the fixing support of the lighting module, According to another aspect, the invention consists in a motor vehicle light comprising at least one lighting module as described above.

Other features, details and advantages of the invention will emerge more clearly on reading the description given hereinafter by way of illustration with reference to the drawings, in which:

FIG. 1 is an overall view of a lighting module in accordance with one embodiment of the invention, showing a fixing support on which are mounted on one side a heat dissipating member and on the other side a casing covering optical elements not visible here and enabling the fixing of a forming. lens;

FIG. 2 is a perspective view from above of the lighting module from FIG. 1, in which the casing and the lens for shaping the rays have been removed, to show the fixing support on which a first optical element is disposed so that it moreover retains the second and third optical elements of the lighting module;

FIG. 3 is a perspective view from above of the optical elements as assembled in FIG. 2, the fixing support having been removed here;

Figure 4:
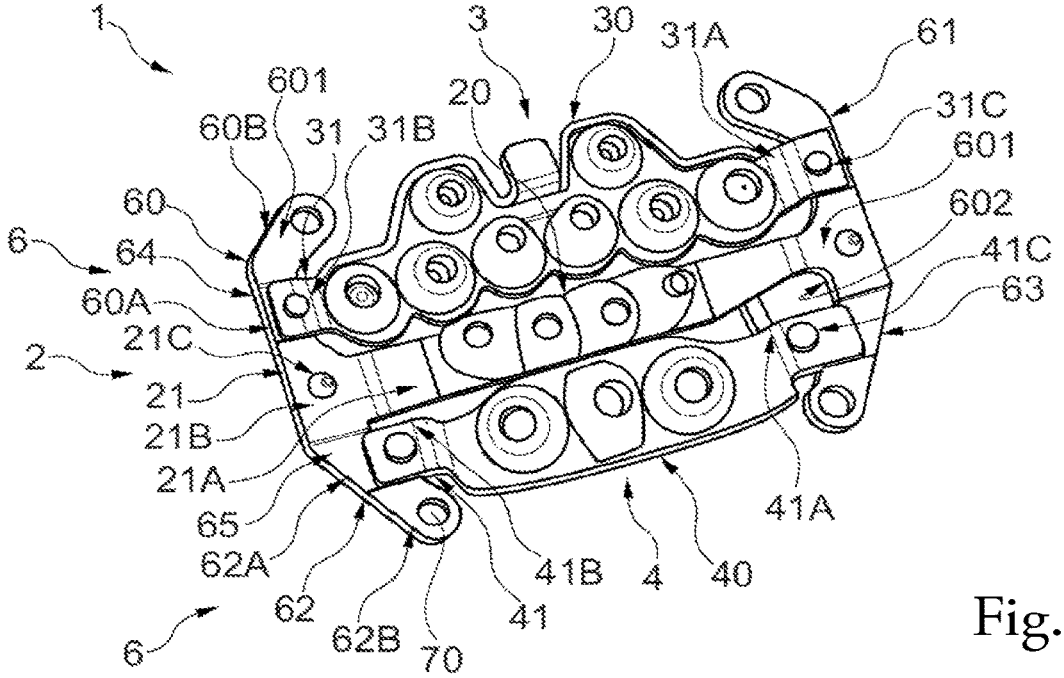
FIG. 4 is a perspective view from below of FIG. 3, notably showing notches for retaining the second and third optical elements and indexing pins of each of the optical elements.
Figure 5:
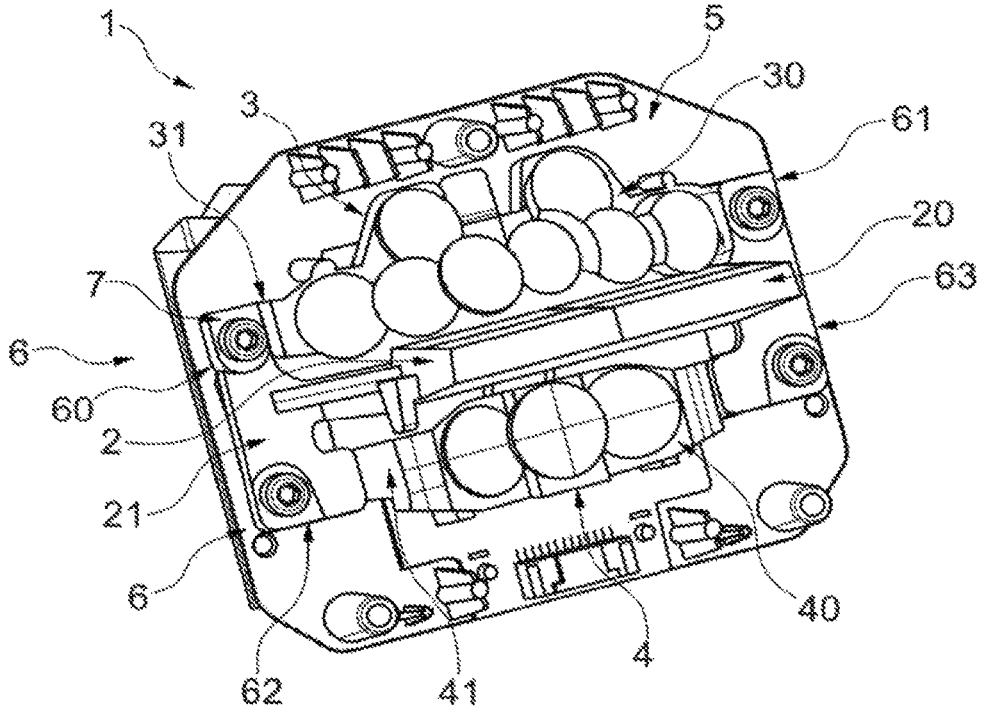
FIG. 5 is a perspective view from above of variant embodiments of the lighting module shown in FIG. 2.

FIG. 1 shows a lighting module 1 according to the invention, otherwise termed an optical module, the function of which is to generate and to project onto a road one or more light beams. A lighting module 1 of this kind is intended to be installed in a light of a motor vehicle that is not shown in the figures in order to facilitate the understanding of the invention. It will be noted that the light referred to here comprises overall a rear housing closed at the front by a transparent outer lens, the latter having passed through it the light rays created by the lighting module according to the invention. A light of this kind can thus receive in its interior volume, delimited by the rear housing and the transparent outer lens, a plurality of lighting modules and at least one lighting module according to the invention.

A lighting module 1 of this kind forms a unitary subassembly, that is to say an object that can fulfil its function with no input other than the electrical energy needed to turn it on.

The lighting module 1 according to the invention is adapted to create a high beam light beam and a low beam light beam, one after the other or simultaneously. As explained in more detail hereinafter, the lighting module 1 is adapted so that the high beam is the combination of the low beam with a complementary beam.

The lighting module 1 comprises at least a plurality of light sources and a plurality of associated optical elements. It also comprises at least one lens 100 arranged at one extremity of the module so as to have the light rays emitted by the light sources and guided by the optical elements passed through it. A shaping lens 100 of this kind participates in the formation of the required light beam, whether it is a low beam type beam or a high beam type beam. In other words, the shaping lens 100 forms a first longitudinal extremity of the lighting module 1.

FIG. 1 also shows the presence of a housing 102 that has a substantially tubular shape and extends between a base forming the fixing support 5 and the shaping lens, a housing of this kind notably providing the mechanical support of the shaping lens, together with mechanical referencing of the position of the lens relative to the light sources and to the optical elements, so as to guarantee a particular position of the shaping lens relative to the light sources.

The fixing support 5 can have on its face opposite the housing 102 a thermal dissipation member 104, intended to evacuate from the lighting module 1 at least some of the heat generated by the light sources.

FIG. 2 shows a part of the lighting module 1, and notably the fixing support 5 without the housing 102, so as to facilitate the understanding of the arrangement in the lighting module 1 of the optical elements associated with the light sources not visible here.

According to the invention, these optical elements are fixed to the fixing support so that one of the optical elements includes means for retaining the other optical elements, so that it is not necessary to provide specific means for fixing those other optical elements onto the fixing support. In the next example, there will be described a lighting module equipped with three optical elements respectively facing a respective light source, and a first optical element will be described as configured to enable the covering and the fixing of the other two optical elements, but it will be understood that a lighting module will conform to the invention as soon as it enables pressing of a plurality of optical elements against the fixing support, and thus their retention in position, by another optical element.

In the example shown and seen more particularly in FIGS. 2 to 5, the lighting module 1 comprises a first optical element 2 configured to guide light rays emitted by a first light source 202, a second optical element 3 configured to guide light rays emitted by a second light source, not visible here, and a third optical element 4 configured to guide light rays emitted by a third light source, not visible here.

In the foregoing description, it is clear that by light source is meant one or more light sources forming a subassembly controlled to emit light rays configured for the implementation of an optical function. To be more precise, the first light source 200, or a first subassembly of light sources, is associated with the first optical element 2 to generate a first light beam, and the second light source, or a second subassembly of light sources, is associated with the second optical element 3 to generate a second light beam. This second light beam corresponds to a high beam type beam, having a cut-off edge formed here by the edge 200 of the free end face 201 of the first optical element 2 that is situated on the second optical element side. The first light beam, leaving this free end face of the first optical element, therefore has a beam shape complementary to the second light beam, so that the simultaneous emission of rays by the first and second sources participates in forming an overall beam of high beam type.

Moreover, the third light source, or third subassembly of light sources, is associated with the third optical element 4 to generate light rays adapted to boost the centre of the high beam type overall beam.

Each of the optical elements has a general shape featuring a central optical portion, forming the optical guide part, and lateral fins, arranged laterally on either side of the central optical portion.

More particularly, and as is particularly visible in FIG. 3, the first optical element 2 comprises a first optical guide part 20 extended at its lateral extremities by first fins 21, the second optical element 3 comprises a second optical guide part 30 extended at its lateral extremities by second fins 31 and the third optical element 4 comprises a third optical guide part 40 extended at its extremities by third fins 41.

These optical elements 2, 3, 4 are designed to be disposed on a fixing support 5, and more particularly on a first face 50 of the fixing support. In the configuration of this embodiment shown, the first optical element 2 is disposed on the fixing support 5 between the second and third optical elements 3, 4.

As mentioned above, according to the invention one of the optical elements 2, and notably the first optical element in the examples to follow, includes means 6 for retaining the other optical elements 3, 4 against the fixing support 5, and notably against the first face 50 of the fixing support. The object of the presence of these retaining means 6 is to retain a plurality of optical elements 3, 4 against the fixing support 5 without exerting any mechanical screwing force directly on those optical elements. More particularly, the retaining means 6 of the first optical element 2 are arranged at the level of the first fins 21 of the first optical element and configured to cover the extremities of the other optical elements.

The assembly of a lighting module of this kind comprises a first step during which optical elements 3, 4 are disposed on the fixing support 5, facing the respective light source to which they correspond to generate an appropriate light beam in the direction of the ray shaping lens of the module. In a second step, the first optical element 2 including the retaining means 6 is disposed on the fixing support 5, against the first face 50 of the latter, so as to cover the extremities of the optical elements 3, 4 already in place, before being fixed to the fixing support 5 by screwing it on with the aid of a fixing means 7, of the clamping screw type. It might be noted that in this configuration the retaining means 6 of the first optical element 2 are disposed around the optical guide parts 20, 30, 40 of the optical elements 2, 3, 4 so that they do not penalize the production of the optical function, that is to say the guiding of the rays emitted by the sources toward the lens 100 for shaping the rays at the outlet of the lighting module 1.

A first embodiment of the lighting module will now be described in more detail, notably with reference to FIGS. 2 to 4.

As it was possible to state above, the first optical element 2 is disposed on the fixing support 5 between the second and third optical elements 3, 4 so that the central optical element, namely the first optical element 2, is used to retain the other optical elements 3, 4. Clearly this embodiment enables substantially equal distribution of the retaining forces between the optical elements retained by the central optical element.

The first optical element 2 comprises means 6 for retaining the second optical element 3 and the third optical element 4 on the fixing support 5. The retaining means 6 of the first optical element 2 are more particularly formed by at least two legs, here four in number, 60, 61, 62, 63 that extend one of the first fins 21 to cover the second and third fins 31, 41 of the second and third optical elements 3, 4. As shown, this covering of the extremities of the second optical element 3 and those of the third optical element 4 does not prevent the optical guide parts 30, 40 from fulfilling their optical functions.

The legs 60, 61, 62, 63 enable separation of the optical function of the first optical element 2 and its function of retaining the second optical element 3 and the third optical element 4.

FIGS. 3 and 4 show the optical elements 2, 3, 4, as they are arranged when they are assembled on the fixing support 5. The various optical elements are configured to guide light rays in the direction of the ray shaping lens, not visible in these figures, principally along an optical axis A represented in FIG. 3. In this configuration, it will be clear that the legs 60, 61, 62, 63 forming part of the retaining means 6 of the first optical element 2 extend perpendicularly to the optical axis A, so as to run along the fixing support 5 and to press against it the second and third optical elements 3, 4.

In a configuration as shown in which the optical elements are arranged in a series in a first direction, the legs 60, 61, 62, 63 extend from the fins 21 extending the first optical element 2 perpendicularly to the optical axis A and in the direction defined by the series arrangement of the optical elements. As a result, at least one leg extends the along fixing support from the first optical element to a second optical element and at least one leg extends along the fixing support from that first optical element to a third optical element.

The retaining means 6 configured to retain the second and third optical elements, formed here by the legs 60, 61, 62, 63, are moreover configured to make it possible to retain the first optical element on the fixing support, by way of a fixing means 7. In the example shown, the fixing means 7 includes a hole 70 at one end of a leg, the hole being configured to receive a fixing screw 71 intended to be accommodated in a bore formed in the fixing support.

Each leg more particularly comprises a first portion 60A, 62A and a second portion 60B, 62B, the first portion being disposed directly in line with the fin 21 of the first optical element 2 and the second portion being configured to extend the first portion beyond the other optical element that this leg contributes to retaining against the fixing support. The second portion comprises the hole 70 forming part of the fixing means of the first optical element, and here this second portion is oriented in a direction different from the direction of the first portion. It will be clear that the orientation of the second portion takes into account the overall size of the lighting module and the space available on the fixing support, as well as the stability to be imparted to the first optical element.

Fixing the first optical element to the fixing support, for example by screwing means, makes it possible to retain the second optical element and the third optical element fixed against the fixing support. As it was possible to state above, this ensures the retention in position of all of the optical elements with a minimum of fixing means.

Each of the optical elements is formed in one piece. The body forming the first optical guide part 20, the fins 21 and the legs 60, 61, 62, 63 is more particularly formed in one piece, as a unitary assembly. As a result, the positioning of the legs against the fixing support generates the positioning of the first optical guide part 20 relative to that fixing support and relative to the light sources carried by that fixing support.

In a variant embodiment of the invention, the legs 60, 61, 62, 63 of the first optical element 2 can be moulded over the fins 21 arranged on either side of the optical guide part 20 of the first optical element 2. This overmoulding enables reduction of the cost of manufacturing the first optical element 2 by using a plastic material different from that used to make the optical guide part 20. It will be noted that at least the optical guide part of the first optical element 2 is made of polycarbonate (PC). A plastic material of this kind has the advantage of offering transparency properties with a good refractive index and appropriate temperature resistance.

The fins 21, 31, 41 of the optical elements 2, 3, 4 are configured to enable the cooperation of the retaining means 6 and the extremities of the second and third optical elements as described hereinafter, and to enable the optical guide parts 20, 30, 40 of those optical elements to be offset longitudinally relative to the plane of the fixing support to leave room for the light sources themselves pressed against the fixing support. A longitudinal offset is therefore necessary between the fins and the optical guide part of each optical element. To this end, and as more particularly seen in FIG. 4, the fins of each optical element 2, 3, 4 are formed by a first portion 21A, 31A, 41A arranged directly in line with the corresponding lateral extremity of the optical guide part 20, 30, 40, and by a second portion 21B, 31B, 41B intended to be pressed against the fixing support 5.

The first portion 21A, 31A, 41A extends longitudinally, substantially parallel to the optical axis of the lighting module and therefore perpendicularly to the fixing support, and so it is the length of this first portion that determines the distance of the guide part of the optical elements from the fixing support to leave room for the light sources. And the second portion 21B, 31B, 41B extends the first portion 21A, 31A, 41A perpendicularly to form a bearing face parallel to the plane principally defining the fixing support.

The legs 60, 61, 62, 63 more particularly extend from the second portion 21B of the fin 21 of the first optical element 2, so as to cover the second portions 31B and 41B of the others optical elements. As shown, a first pair of legs 60, 61 formed by a first leg 60 and a second leg 61 is associated with the second optical element 3 and a second pair of legs 62, 63 formed by a third leg 62 and a fourth leg 63 is associated with the third optical element 4. The first leg 60 and the second leg 61 are disposed so as to face one each other so as to cover the extremities of the second optical element 3, while the third leg 62 and the fourth leg 63 are disposed facing each other so as to cover the extremities of the third optical element 4.

As is shown in FIG. 3, the legs 60, 61 of the first pair of legs are identical to one another and the legs 62, 63 of the second pair of legs are also identical to one another, although different from the legs of the first pair of legs. Clearly this is specific to the embodiment shown in which the second and third optical elements 3, 4 are of different shapes, but the pairs of legs could be the same if the optical elements had to have different shapes and dimensions.

The legs 60, 61, 62, 63 each include a first face 601, intended to be pressed against the fixing support. On this first face, the legs include notches 64, 65 sized to receive a fin 31, 41, respectively, of the other optical elements 3, 4 disposed on either side of the first optical element 2. These notches consist in a thinner zone formed from the inside edge 602 of the legs forming the retaining means 6 fastened to the first optical element, the inside edge 602 being that facing toward the optical guide part. The notches can be obtained by machining the first face 601 or formed during an operation of moulding the first optical element. The second fins 31 formed at the lateral extremities of the second optical element 3 are intended to be accommodated in a pair of first notches 64 respectively arranged on one of the legs of a first pair of legs 60, 61. In the same way, the third fins 41 formed at the extremities of the third optical element 4 are accommodated in second notches 65 respectively arranged on one of the legs of a second pair of legs 62, 63.

The thickness of the fins 31, 41 of the second and third optical elements is substantially equal to the depth of the notches 64, 65, the thickness and the depth being measured with the optical elements assembled onto the fixing support in a direction perpendicular to the plane in which that fixing support extends. As a result, when the optical elements are assembled onto the fixing support 5, the positioning of the fins in the notches does not prevent the first face 601 of the legs of the first optical element, which is disposed on the fixing support after the other optical elements, from being pressed against the fixing support 5.

In FIG. 4 there has been made more particularly visible the first face 601 of the retaining means, in which are formed the notches receiving the fins of the second and third optical elements.

This first face includes indexing pins 21C projecting from the fins 21 and configured to be of corresponding shape and size to orifices formed in the fixing support 5 and not visible here. In a similar way, each of the fins 31, 41 of the other optical elements includes an indexing pin 31C, 41C facing toward the first face 601 of the retaining means when the optical elements are assembled against the fixing support, and configured to correspond to an orifice formed in the fixing support. Thanks to these pins, it is possible to pre-position each optical element 2, 3, 4 on the fixing support 5 before final fixing by means of the fixing means 7. This guarantees that each optical element 2, 3, 4 is correctly positioned relative to the fixing support 5 and relative to the light sources previously fastened to the fixing support, notably by gluing them onto a printed circuit card fastened to this fixing support and not shown here. It is clear that, for each optical element 2, 3, 4, this enables alignment of the optical guide part 20, 30, 40 with a light source or a corresponding subassembly of light sources.

It is more particularly to be noted that the indexing pins 21C, 31C, 41C are formed on the second portions of the fins 21, 31, 41. Accordingly, during a first assembly step, the optical elements 2, 3, 4 are easily disposed on the fixing support 5, through contact of the second portions of the fins 21, 31, 41 against this fixing support, it being understood that the second and third optical elements are disposed beforehand to enable their extremities to be covered by the retaining means formed by the first optical element 2.

The indexing pin 31C can advantageously be located in a part of the fin of a second and/or third optical element that is covered afterwards by one of the legs of the first optical element. This makes the assembly more compact as the means fulfilling the pre-positioning function and those fulfilling the fixing function by covering are stacked one on the other.

The indexing pins 21C, 31C, 41C of the optical elements 2, 3, 4 enable on the one hand individual positioning of each of the optical elements 2, 3, 4 in the required optical configuration and on the other hand positioning of the optical elements 2, 3, 4 relative to one another so as to enable the complementary nature of the optical functions that they provide, and notably so as to generate, alternatively, a first, so-called high beam luminous flux, and a second, so-called low beam luminous flux. It will be clear that the indexing pins 21C, 31C, 41C enable immobilization of their respective optical element 2, 3, 4 in a direction perpendicular to the optical axis A, while the legs 60, 61, 62, 63 of the first optical element 2 enable immobilization of the second and third optical elements 3, 4 in a direction parallel to the optical axis A, the first optical element 2 being fixed to the fixing support 5 by screwing it on.

According to variant embodiments of the invention shown in FIG. 4, the fixing means 7 of the legs 60, 61, 62, 63 may be arranged in the vicinity of the notches. There has more particularly been shown a first variant for fixing the second optical element and a second variant for fixing the third optical element. In each of these variants, in accordance with the invention, the first optical element includes retaining means configured to fix the other optical elements against the fixing support.

According to a first variant, the fixing means is arranged laterally in line with the notch of the corresponding leg, in which it is intended there should be accommodated, as before, one extremity of an optical element. The guide part of the optical element, a fin and a hole forming part of the fixing means are thus arranged successively in line. According to the foregoing disclosure, the fixing means enabling fixing of the first optical element onto the support are dissociated from the receiving notches of the other optical elements, so that the other optical elements are retained only by the pressure force exerted by the legs of the first optical element, and therefore without it being necessary specifically to machine the third optical element and risk degrading its optical performance.

According to the second variant, the fixing means is arranged through a notch. The hole is formed on the leg 60, 61, 62, 63 to pass through the corresponding notch and to be in corresponding relationship, on the one hand, with an opening formed in the corresponding fin 31, 41 of the second or third optical element 3, 4 and, on the other hand, a bore in the fixing support 5. This variant embodiment enables a more compact assembly to be obtained in that the leg does not have to be extended beyond the notch to provide a space to receive fixing means.

It will be clear that the features of either of the embodiments or of the variants described can advantageously be combined with one another. Of course, the features, the variant embodiments of the invention can be associated with one another, in various combinations, to the extent that they are not incompatible or mutually exclusive. There may notably be imagined variants of the invention comprising only a selection of the features described separately from the other features described if that selection of features is sufficient to confer a technical advantage or to distinguish the invention from the prior art.

The invention claimed is:

1. A lighting module for a motor vehicle light, the lighting module comprising:

light sources;

optical elements respectively configured to guide light rays emitted by a light source; and a fixing support against which the optical elements and the light sources are disposed, the optical elements comprising a first optical element associated with a first light source, a second optical element associated with a second light source and a third optical element associated with a third light source, the first optical element comprises a retainer to retain the second optical element and the third optical element on the fixing support, without exerting a mechanical screwing force directly on the second optical element and the third optical element.

2. The lighting module according to claim 1, wherein the retainer is configured to cover at least a part of the second optical element and a part of the third optical element.

3. The lighting module according to claim 1, wherein the retainer includes, on a first face pressed against the fixing support, at least one notch sized to accommodate one end of the second or third optical element.

4. The lighting module according to claim 1, wherein the retainer is configured to fix the first optical element to the fixing support.

5. The lighting module according to claim 1, wherein each of the optical elements includes an optical guide part, configured to guide the light rays emitted by the first light source and extended laterally by fins, fins of the first optical element being configured to carry the retainer, an optical guide part of the first optical element being disposed between the second optical element and the third optical element.

6. The lighting module according to claim 5, wherein the optical guide part and the retainer are formed in one piece.

7. The lighting module according to claim 6, wherein the retainer is moulded over the optical guide part, at least the optical guide part being made of polycarbonate (PC).

8. The lighting module according to claim 5, wherein the retainer includes legs extending lateral extremities of the optical guide part of the first optical element on either side to cover the second optical element and the third optical element.

9. The lighting module according to claim 5, wherein at least one fin of an optical element comprises an indexing pin configured to cooperate with an orifice formed in the fixing support.

10. The lighting module according to claim 9, wherein at least one indexing pin fastened to a second optical element and/or a third optical element projects from a second part of a fin of said optical element covered by the first optical element at the level of a notch.

11. The lighting module according to claim 5, wherein the fins of each optical element are formed by a first portion directly extending the corresponding lateral extremity of the optical guide part and by a second portion configured to be pressed against the fixing support.

12. The lighting module according to claim 11, wherein the second portions of the fins of the second and third optical elements are at least partially accommodated in notches, the second portions of the fins of the first optical element being extended by the retainer.

13. The lighting module according to claim 12, wherein the first optical element is disposed between the second optical element and the third optical element so that the first optical element is configured to participate in formation of a beam complementary to the beam formed by the second optical element, said third optical element being configured to enable formation of an additional beam that boosts the overall beam formed by complementary nature of said beam and additional beam.

14. The lighting module according to claim 1, wherein each optical element is configured to emit a light beam in a direction of a shaping lens at an outlet of the lighting module.

15. A motor vehicle light comprising at least one lighting module according to claim 1.

16. The lighting module according to claim 2, wherein the retainer includes, on a first face pressed against the fixing support, at least one notch sized to accommodate one end of the second or third optical element.

17. The lighting module according to claim 2, wherein the retainer is configured to fix the first optical element to the fixing support.

18. A lighting module, comprising:

light sources;

optical elements respectively configured to guide light rays emitted by a light source; and a fixing support against which the optical elements and the light sources are disposed, the optical elements comprising a first optical element associated with a first light source, a second optical element associated with a second light source and a third optical element associated with a third light source, the first optical element comprises a retainer to retain the second optical element and the third optical element on the fixing support, wherein each of the optical elements includes an optical guide part, configured to guide the light rays emitted by the first light source and extended laterally by fins, fins of the first optical element being configured to carry the retainer, an optical guide part of the first optical element being disposed between the second optical element and the third optical element.

19. The lighting module according to claim 6, wherein the retainer includes legs extending lateral extremities of the optical guide part of the first optical element on either side to cover the second optical element and the third optical element.

20. The lighting module according to claim 6, wherein at least one fin of an optical element comprises an indexing pin configured to cooperate with an orifice formed in the fixing support.

* * * * *